US005173108A

United States Patent [19]

Houck

[11] Patent Number: 5,173,108

[45] Date of Patent: Dec. 22, 1992

[54] METHOD FOR CONTROLLING THE OXYGEN CONTENT IN AGGLOMERATED MOLYBDENUM POWDERS

[75] Inventor: David L. Houck, Towanda, Pa.

[73] Assignee: GTE Products Corporation, Stamford, Conn.

[21] Appl. No.: 790,120

[22] Filed: Nov. 12, 1991

Related U.S. Application Data

[63] Continuation of Ser. No. 515,535, Apr. 13, 1990, abandoned, Continuation of Ser. No. 326,826, Mar. 21, 1989, abandoned.

[51] Int. Cl.[5] ..... B22F 9/00

[52] U.S. Cl. ..... 75/365; 75/354; 75/357; 75/359; 75/360; 75/361; 75/363; 75/370

[58] Field of Search ..... 423/606; 75/354, 355, 75/357, 359, 360, 363, 364, 361, 365, 370, 252

[56] References Cited

U.S. PATENT DOCUMENTS

| | | | |
|---|---|---|---|
| 3,973,948 | 8/1976 | Laferty, Jr. et al. | 427/216 |
| 4,146,388 | 3/1979 | Lafferty et al. | 75/0.5 BB |
| 4,390,368 | 6/1983 | Houck | 75/342 |
| 4,395,279 | 7/1983 | Houck | 75/343 |
| 4,502,885 | 3/1985 | Cheney | 75/357 |
| 4,508,788 | 4/1985 | Cheney | 75/252 |
| 4,595,412 | 6/1986 | Brunelli et al. | 75/363 |
| 4,624,700 | 11/1986 | Port et al. | 75/0.5 BB |
| 4,705,560 | 11/1987 | Kemp, Jr. et al | 75/342 |
| 4,711,661 | 12/1987 | Kemp, Jr. et al. | 75/252 |
| 4,773,928 | 9/1988 | Houck et al. | 75/342 |
| 4,783,214 | 11/1988 | Kemp, Jr. et al. | 75/252 |
| 4,783,218 | 11/1988 | Kemp, Jr. et al. | 75/342 |

FOREIGN PATENT DOCUMENTS

| | | | |
|---|---|---|---|
| 561559 | 8/1958 | Canada | 75/359 |
| 292798 | 11/1988 | European Pat. Off. | 75/359 |

*Primary Examiner*—Wayne Langel
*Assistant Examiner*—Steven Bos
*Attorney, Agent, or Firm*—Elizabeth A. Levy

[57] ABSTRACT

A method is disclosed for producing an agglomerated molybdenum plasma spray powder with a controlled level of oxygen which comprises forming a relatively uniform mixture of agglomerated powders containing molybdenum dioxide and one or more ammonium-containing compounds of molybdenum wherein the mixture has an oxygen content of greater than about 25% by weight and reducing the mixture in a moving bed furnace at a temperature of from about 700° C. to about 1000° C. for a sufficient time to remove a portion of the oxygen therefrom and form reduced molybdenum powder agglomerates having an oxygen content of no greater than about 25% by weight. The reduction takes place in the direction from the outside surface of the agglometates to the inside surface.

1 Claim, No Drawings

METHOD FOR CONTROLLING THE OXYGEN CONTENT IN AGGLOMERATED MOLYBDENUM POWDERS

This is a continuation of copending application Ser. No. 07/515,535, filed on Apr. 13, 1990, now abandoned which is a continuation of copending application Ser. No. 07/326,826, filed on Mar. 21, 1989, now abandoned.

CROSS REFERENCE TO RELATED APPLICATION

This invention is related to application 07/326,827, filed Mar. 21, 1989, now abandoned, entitled "Method For Controlling The Oxygen Content In Agglomerated Molybdenum Powders", which is filed concurrently herewith.

BACKGROUND OF THE INVENTION

This invention relates to a method for controlling the oxygen content of agglomerated molybdenum-containing powders by controlled reduction thereof. More particularly it relates to a method of introducing a controlled amount of oxygen into agglomerated molybdenum-containing powders by reducing powders of molybdenum dioxide and one or more ammonium-containing compounds of molybdenum.

Flame spraying and plasma spraying are common techniques for the application of protective and wear resistant coatings of various metals, ceramics, and cermets, usually to metal surfaces (substrates). Flame spraying is commonly used to produce molybdenum-containing coatings on piston rings for internal combustion automobile engines and synchronizer rings for manual transmissions for automobiles and trucks.

An electric arc or flame can be used to melt the end of a continuously fed coil of molybdenum wire as a gas propels the molten droplets which form onto a substrate for example, the wear surface of a cast iron piston ring where it splats and solidifies, forming the coating in successive layers. Because of the presence of excess oxygen either from the flame or the surrounding air, or both, the coatings produced by this technique contain large quantities of oxygen, typically from about 7% to about 8% in solution and as various molybdenum oxides. The large quantities of oxygen in the molybdenum harden the coating.

In the plasma spraying of molybdenum, there is usually a minimum of oxygen in the sprayed coating due to the use of an oxygen-lean plasma gas system. That is, argon, helium, hydrogen, nitrogen, or combinations of these gases, all of which are relatively free from oxygen, are used in the plasma spraying process. Hence, any oxygen in the sprayed coating is due to oxidation of the molten particles caused by oxygen from the surrounding air mixing with the plasma gas and/or surface oxidation of the freshly deposited coating. In such "pure" molybdenum coatings the oxygen level is in the 1% to 2% range. Such coatings are softer than their flame sprayed counterparts.

For higher hardness, therefore, a more expensive process such as the flame spray process which requires wire, or a more expensive powder such as molybdenum plus nickel-base alloy must be used.

It would be desirable therefore to have a method of producing molybdneum powders of sufficiently high oxygen content to enable them to be used in a plasma spray process to produce hard coatings.

U.S. Pat. No. 4,624,700 relates to a method to control the oxygen content of agglomerated molybdenum powders by controlled reduction of the powders. This is done by reducing a mixture of molybdenum and one or more oxygen containing compounds of molybdenum under controlled conditions. The mixture is made up of molybdenum and typically mixtures of compounds such as molybdenum dioxide, molybdenum trioxide and ammonium paramolybdate.

U.S. Pat. No. 4,146,400 relates to a method for introducing a controlled level of oxygen into an agglomerated molybdenum metal powder involving heating the powder at a sufficient temperature for a sufficient time in the presence of water vapor and a non-oxidizing atmosphere with the amount of non-oxidizing atmosphere being controlled to produce a partially-oxidized molybdenum powder.

U.S. Pat. No. 4,146,388 describes and claims molybdenum plasma spray powders and a process for producing the powders of molybdenum and oxides of molybdenum having an oxygen content of from about 0.5 to about 15% by weight oxygen. The process involves passing molybdenum particles through a plasma with oxygen or oxides of molybdenum to produce the oxidized powder.

SUMMARY OF THE INVENTION

In accordance with one aspect of this invention, there is provided a method for producing an agglomerated molybdenum plasma spray powder with a controlled level of oxygen which comprises forming a relatively uniform mixture of agglomerated powders containing molybdenum dioxide and one or more ammonium-containing compounds of molybdenum wherein the mixture has an oxygen content of greater than about 25% by weight and reducing the mixture in a moving bed furnace at a temperature of from about 700° C. to about 1000° C. for a sufficient time to remove a portion of the oxygen therefrom and form reduced molybdenum powder agglomerates having an oxygen content of no greater than about 25% by weight. The reduction proceeds in the direction from the outside surface of the agglomerates to the inside surface.

DETAILED DESCRIPTION OF THE INVENTION

For a better understanding of the present invention, together with other and further objects, advantages and capabilities thereof, reference is made to the following disclosure and appended claims in connection with the above description of some of the aspects of the invention.

In the particular applications in which the controlled oxygen molybdenum powders resulting from the method of this invention are preferably used, that is, in plasma spray applications to produce plasma spray coatings, the desired oxygen content is typically no greater than about 10% and most preferably from about 7% to about 10% by weight. At levels lower than this, the hardness and wear resistance of the plasma sprayed coating is not sufficiently improved. At levels higher than this range, the coating integrity or bond strength is compromised.

According to the present invention the mixture consists essentially of molybdenum dioxide, and one or more ammonium-containing compounds of molybdenum. The ammonium-containing compounds of molybdenum are normally ammonium paramolybdate, ammonium dimolybdate and combinations of these. Most preferred is ammonium paramolybdate.

It is to be understood that any mixture of molybdenum dioxide and ammonium-containing compounds can be used as long as the oxygen content of the agglomerated mixture is greater than about 25% by weight.

The mixture can be agglomerated by any of several methods well known in the art.

One preferred method of agglomerating the powders involves generally forming a slurry of water, ammonia or ammonium hydroxide, molybdenum trioxide, and molybdenum dioxide particles. Ammonium paramolybdate is formed from the molybdenum trioxide and ammonium hydroxide and acts as the binder in this system. The resulting slurry is then spray dried to remove the water and form the relatively uniform agglomerated mixture which consists of essentially spherical particles. The above method of forming the agglomerated mixture is described in U.S. Pat. No. 3,973,948 which is hereby incorporated by reference.

Another method of forming the relatively uniform agglomertated mixture is by first forming a slurry as described above. The water is allowed to evaporate while the slurry is being continually stirred to break up the material. The resultant coarse moist powder is then forced through a 100 mesh screen and collected. The powder is then further dried with gentle agitation. The final agglomerated mixture is then screened from this dried mixture.

As an alternative to forming the ammonium paramolybdate (APM) in the slurry, commercially available APM crystals can be dissolved in the water to be used to form the slurry.

Some preferred methods of agglomerating the molybdenum powder are disclosed also in a paper entitled "Properties of Oxygen Bearing Molybdenum Coatings," published in the proceedings of the Ninth International Thermal Spray Conference, Denhaag, Netherlands, May 19-23, 1980.

The resulting agglomerated mixture is then reduced at a temperature of from about 700° C. to about 1000° C. for a sufficient time to remove a portion of the oxygen and form a molybdenum powder having an oxygen content of no greater than about 25% and preferably from about 7% to about 10% by weight.

The reduction is done in a dry hydrogen atmosphere in standard moving bed type furnace such as a fluidized bed or rotary furnace. The time depends on the temperature and on the nature of the equipment. However, typical times are from about 2 hours to about 4 hours. The reducing conditions are adjusted to give the final desired oxygen content. The advantages of using a fluidized bed or rotary calciner in the method of the present invention over static bed reduction are that a bed depth problem is avoided resulting in a more uniform reduction than in the static bed furnace. In a fluidized bed or rotary calciner the reduction of the agglomerates takes place from the outside of the agglomerates to the inside resulting in the metal phase being on the outside of the agglomerates. This results in a more efficient melting of the agglomerates in the plasma application and therefore produces a coating with better bonding charactristics.

The resulting powders with controlled oxygen levels are used in plasma spraying applications to produce coatings such as on synchronizer rings and piston rings.

To more fully illustrate this invention, the following non-limiting example is presented. All parts, portions, and percentages are on a weight basis unless otherwise stated.

EXAMPLE

An aqueous slurry is made up consisting essentially of about 85% solids, the solids consisting essentially of molybdenum dioxide. The slurry containing the molybdenum dioxide is milled in a conventional attritor mill to ensure that the molybdenum dioxide particles are all less than about 10 micrometers in diameter. Ammonium paramolybdate crystals are then added to the slurry. The APM crystals are added to the slurry in a ratio of about 4.5 pounds of APM per gallon of water. The ratio is slightly less than the maximum solubility limit of APM in water. The slurry is dried in a conventional spray dryer to produce relatively uniform agglomerated mixture consisting of particles which are essentially spherical in shape. The mixture is reduced in dry hydrogen at about 800° C. for about 2 hours resulting in a free-flowing molybdenum spray powder having an oxygen content of from about 7% to about 8%.

While there has been shown and described what are at present considered the preferred embodiments of the invention, it will be obvious to those skilled in the art that various changes and modifications may be made therein without departing from the scope of the invention as defined by the appended claims.

What is claimed is:

1. A method of producing an agglomerated molybdenum plasma spray powder with a controlled level of oxygen, said method comprising:

a) milling molybdenum dioxide powder to a particle size less than about 10 micrometers;

b) forming a slurry consisting of said milled molybdenum dioxide powder and ammonium paramolybdate crystals dissolved in water;

c) forming a uniform mixture of agglomerated powders consisting of molybdenum dioxide and ammonium paramolybdate by drying said slurry, wherein the mixture has an oxygen content of greater than about 25% by weight; and d) reducing said mixture in a rotating bed furnace in a hydrogen atmosphere at a temperature of from about 700° C. to about 1000° C. for a sufficient time to remove a portion of the oxygen therefrom and form reduced molybdenum powder agglomerates having an oxygen content of from about 7% to about 10% by weight.

* * * * *